United States Patent [19]

Schultz

[11] Patent Number: 5,064,089

[45] **Date of Patent: * Nov. 12, 1991**

[54] VENTED HATCH COVER

[75] Inventor: Francis R. Schultz, Woodridge, Ill.

[73] Assignee: Salco Products Inc., Romeoville, Ill.

[ * ] Notice: The portion of the term of this patent subsequent to Apr. 11, 2006 has been disclaimed.

[21] Appl. No.: 491,337

[22] Filed: Mar. 8, 1990

[51] Int. Cl.[5] ..... B65D 51/16; B01D 50/00; B01D 39/08

[52] U.S. Cl. ..... 220/372; 220/314; 220/371; 220/374; 55/511; 55/495; 55/385.1; 55/385.2

[58] Field of Search ..... 220/314, 367, 370, 371, 220/372, 374; 55/511, 495, 385.2, 385.1

[56] References Cited

U.S. PATENT DOCUMENTS

| | | | |
|---|---|---|---|
| 418,867 | 1/1890 | Dundon | 220/314 |
| 1,266,926 | 5/1918 | Dundon | 220/314 |
| 2,324,356 | 0/0000 | Brown | 220/314 |
| 2,641,202 | 6/1953 | Talmey et al. | 220/207 |
| 2,825,276 | 3/1958 | Porter | 220/372 |
| 4,127,216 | 11/1978 | Martin, Jr. et al. | 220/367 |
| 4,315,579 | 2/1982 | Martin, Jr. | 220/371 |
| 4,461,219 | 7/1984 | Bateson | 220/314 |
| 4,609,126 | 9/1986 | Janda | 220/367 |
| 4,690,070 | 9/1987 | Miller | 220/314 |
| 4,819,830 | 4/1989 | Schultz | 220/371 |

*Primary Examiner*—Stephen Marcus
*Assistant Examiner*—Paul A. Schwarz
*Attorney, Agent, or Firm*—Kinzer, Plyer, Dorn, McEachran & Jambor

[57] ABSTRACT

A vented hatch cover for an enclosed vessel having a cover body sized to overlie and cover a hatch opening defined by an upstanding coaming. A pair of air passages are defined by the cover body and a pair of hoods connected thereto. The hoods define air inlet opening and a plenum which communicates with air outlet openings in the interior of the cover body. The air passages permit air flow in sufficient volume to vent the vessel and to empty the vessel by high speed vacuum unloading. A filter is removably retained on the hoods in the air inlet openings. A filter screen on the interior of the cover prevents contamination of the air passages from the inside. A latching arm provides downward pressure on the hatch when in a sealing position and the capability of pivoting the hatch cover together with the latching arm when it is moved. The cover is floatingly engaged in the arm.

34 Claims, 3 Drawing Sheets

Fig. 7.
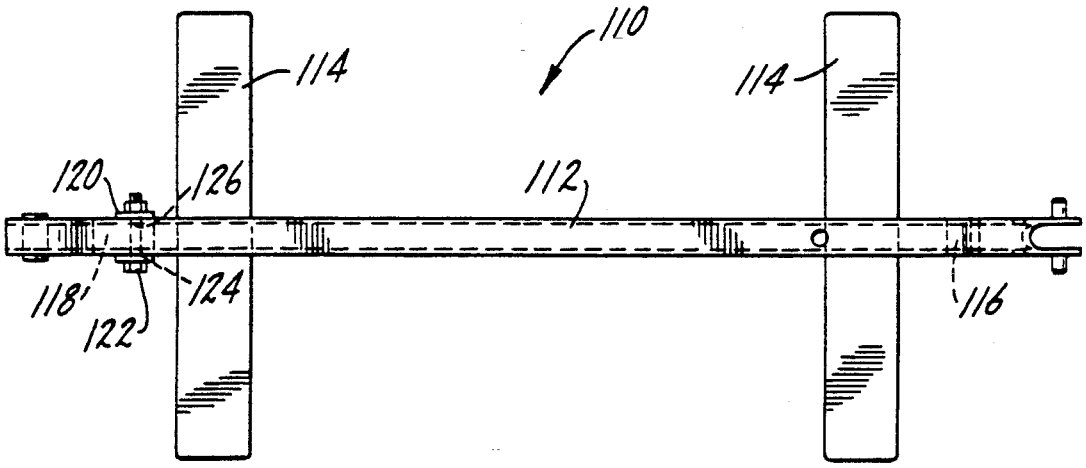
Fig. 8.
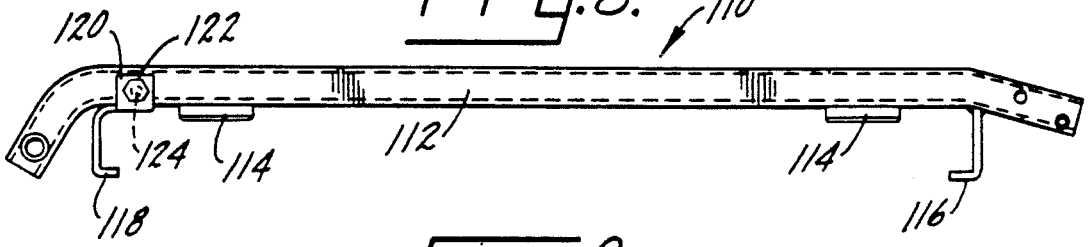
Fig. 9.
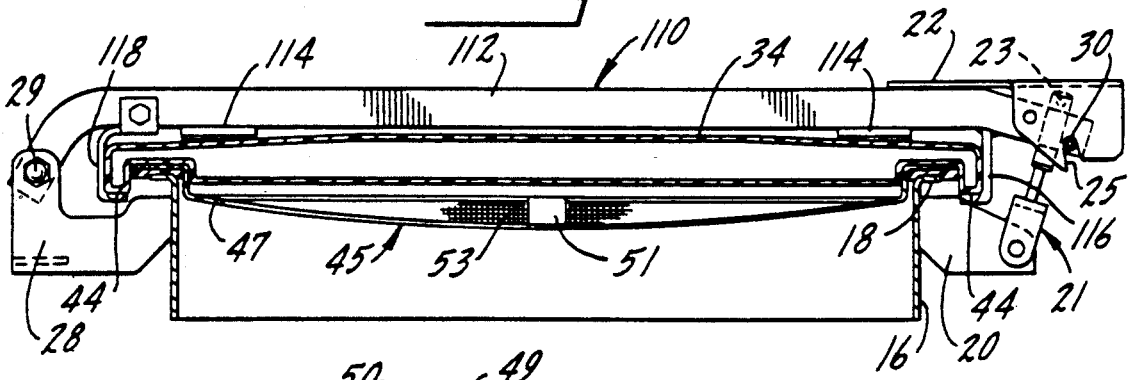
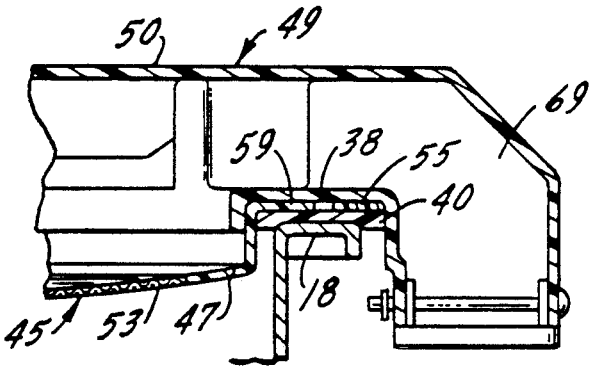
Fig. 10.

VENTED HATCH COVER

BACKGROUND OF THE INVENTION

Railroad hopper cars carrying bulk particulate matter, such as grain or plastic pellets, are typically unloaded by applying a vacuum conveying line to an outlet gate positioned at the bottom of each car compartment. The primary air flow for the vacuum conveying line is obtained from the exterior of the car. That is, the exhaust air for unloading is not drawn from the car compartment through the particulate matter. Nevertheless, the top of the car compartment must be vented to compensate for material drawn out the bottom of the compartment. Failure to vent the top of the compartment would reduce the efficiency of the vacuum unloading process and even risk damage to the car structure. Certain cars have been equipped with vents, but these are inadequate for unloading purposes. Brown, U.S. Pat. No. 2,324,356 is an example. Most commonly, venting for unloading of hopper cars has been achieved by propping open at least one hatch cover on each hopper compartment being unloaded.

Opening hatch covers presents disadvantages. First, some means permitting safe access to the top of the railroad car must be provided. One possibility is to attach ladders and platforms to the car which a worker can use to climb onto the top of the car. Alternatively, the unloading facility may have a gantry or the like, providing safe access to the top of the railroad car. Either of these methods unduly complicates the necessary facilities. Secondly, open hatches tend to invite security problems. Not only is there a risk of contaminating the lading due to the open hatch, but also empty compartments are tempting disposal sites for assorted refuse after the lading has been removed. Further, unless the hatch cover is secured by hinges or the like there is a possibility of the cover being misplaced.

A vented hatch cover for use in the interior of a car is taught by Talmey, U.S. Pat. No. 2,641,202. In essence, Talmey has a double-walled roof structure with a sealed hatch door on the outer wall and a vent in a hatch cover in the inner wall which overlies the hatch opening. If the roof hatch is open, any contaminant such as rain, snow, or the like, may enter the associated vessel directly through the filter. If the roof hatch is not open, only air available between the walls of the car can enter the compartment through the inner cover, but exterior air is not available.

A vented hatch cover having a downwardly or inwardly directed vent opening which is protected from the elements is taught by Schultz in U.S. Pat. No. 4,819,830. The hatch cover taught therein and the present invention have a common inventor and are assigned to a common assignee. The present invention represents a refinement in the development of vented hatch covers of the type in U.S. Pat. No. 4,819,830.

SUMMARY OF THE INVENTION

The present invention overcomes the problems described above by providing a vented hatch cover for a vessel or compartment which need not be opened to accommodate unloading of the associated vessel. The hatch cover is suitable for use with any vessel which requires venting, and is especially suitable for hopper cars using a vacuum draw at the outlet gate for discharge of the contents. The hatch cover provides sufficient venting capacity to substantially eliminate negative pressures within the vessel at normal discharge rates.

The hatch cover comprises a shell member sized to fit over the hatch opening, in engagement with the hatch coaming. At least two hoods are attached to the shell member. Each hood defines an air flow passage extending from an air inlet opening to an air outlet. The air inlet is exposed to the exterior of the car and the air outlet communicates with the interior of the car. Air filter elements may be disposed in or over the air intake openings to filter out contaminants. The filter elements are removable for cleaning. Similarly, a removable screen on the underside of the shell member prevents entrapment in the air flow passages of contaminants or lading from the interior of the car.

In another aspect the invention discloses a floating connection of the hatch cover to a locking arm which permits adjustable positioning of the cover on the hatch coaming during closure while retaining the cover on the arm during opening.

BRIEF DESCRIPTION OF THE DRAWINGS

FIG. 7 is a plan view of the latching mechanism according to the present invention.

FIG. 8 is a side view of the latching arm of FIG. 7.

FIG. 9 shows a cross-sectional view of the latching arm of FIGS. 7 and 8 attached to the coaming.

FIG. 10 is a section through the hatch cover and coaming, on an enlarged scale, showing the details of the mounting arrangement for an interior filter screen.

DETAILED DESCRIPTION OF THE INVENTION

Figure 1:
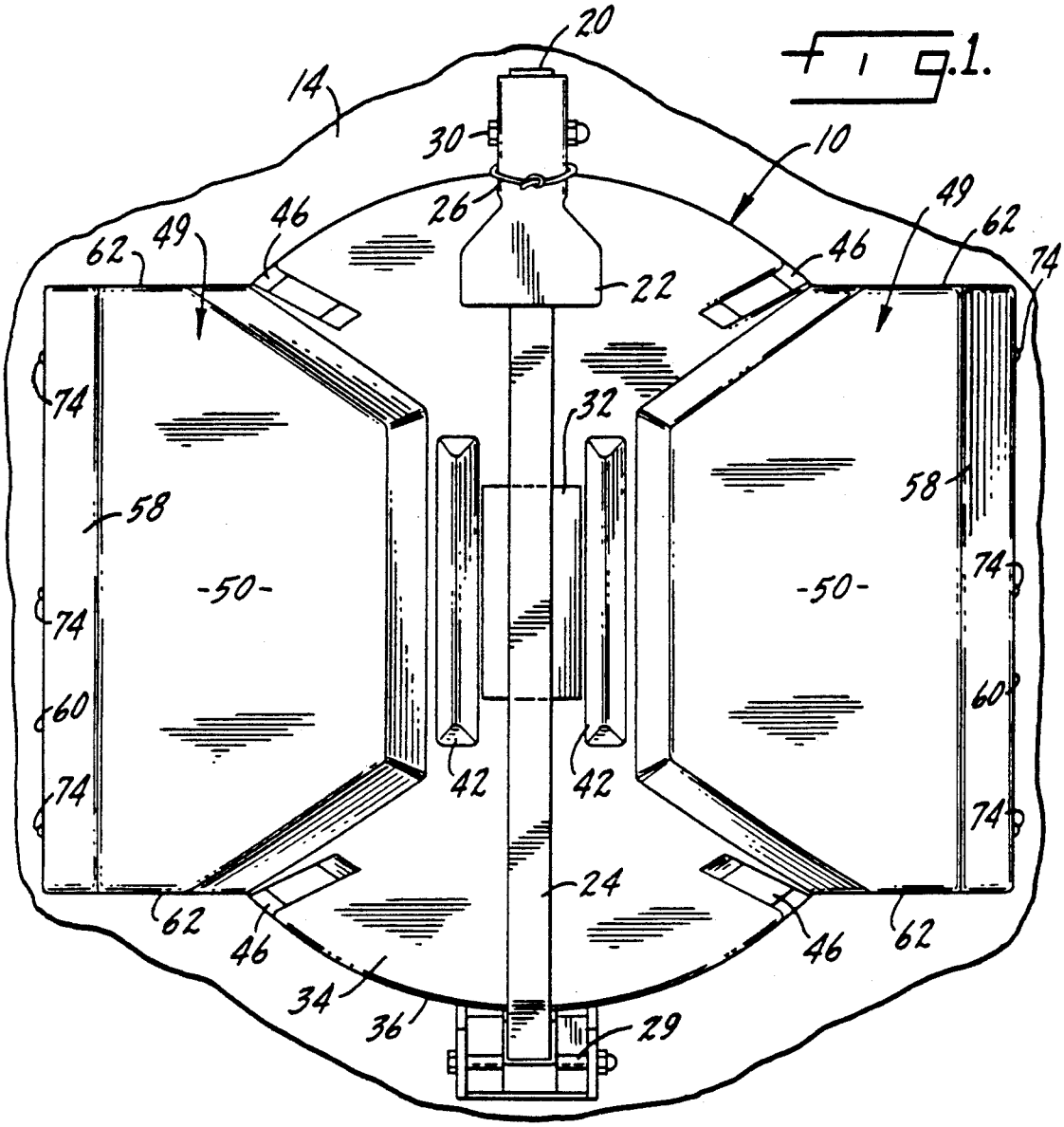
FIG. 1 is a top view of the vented hatch cover with two hoods shown secured to a hatch opening.
Figure 2:
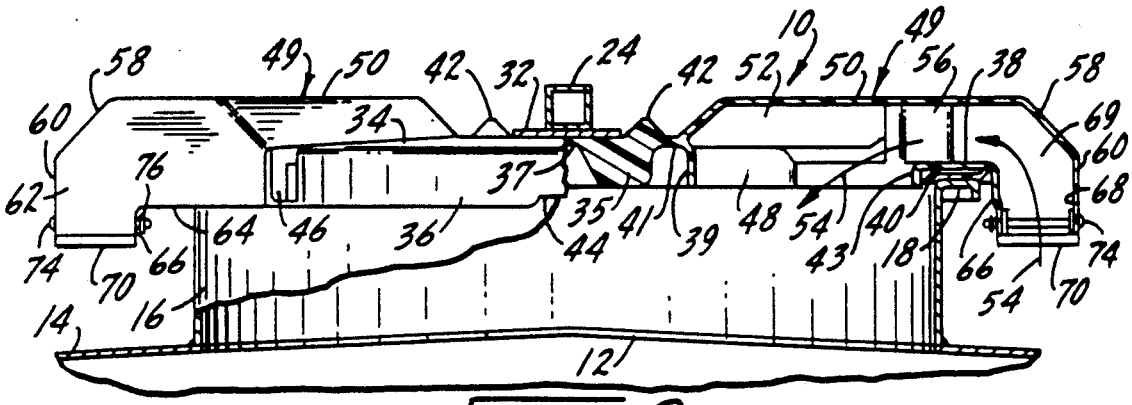
FIG. 2 is a front elevation view of the hatch cover of FIG. 1, in partial section.
Figure 3:
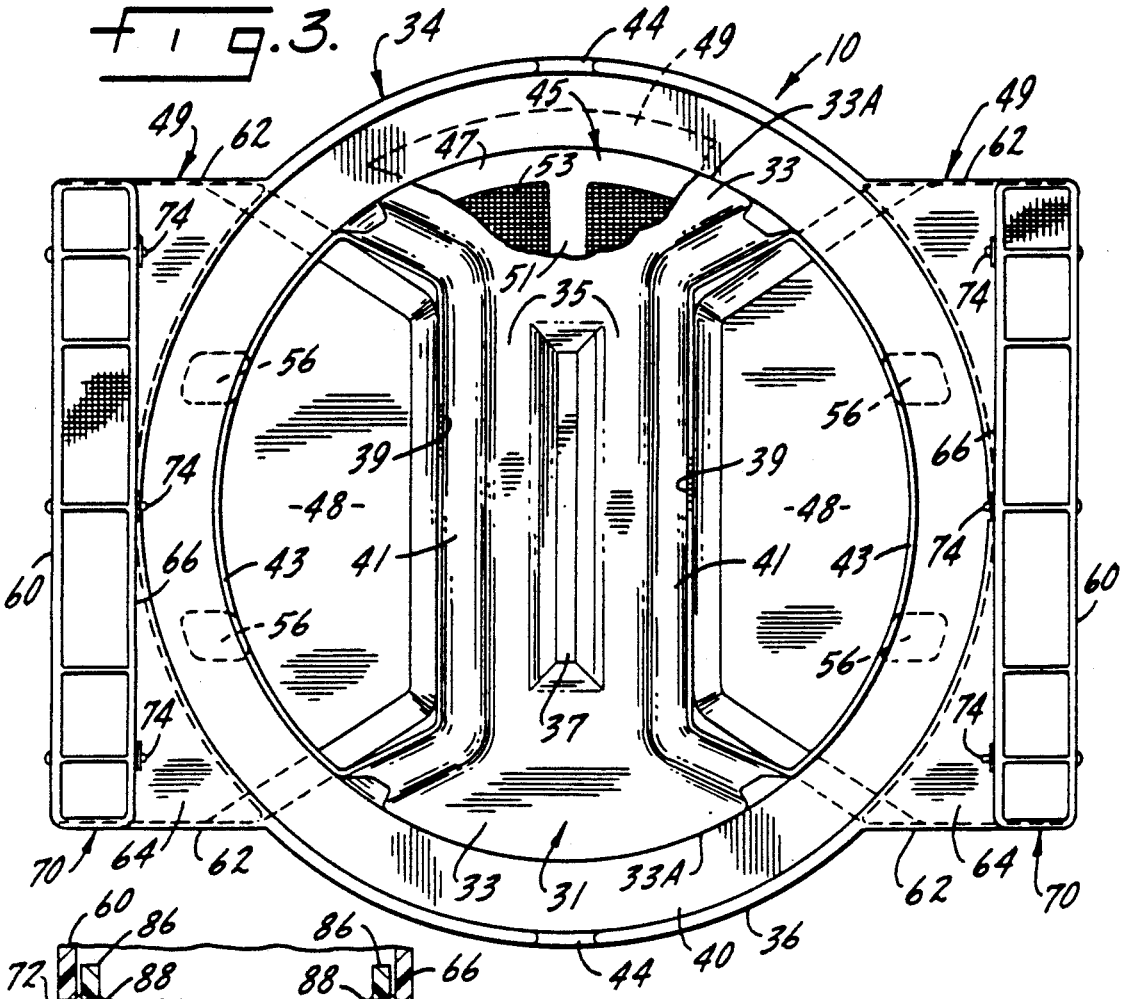
FIG. 3 is a bottom plan view of the vented hatch cover.

FIGS. 1–3 illustrate the hatch cover 10 of the present invention in association with a hatch opening 12 in the roof 14 of a covered railroad hopper car (not shown). Hatch opening 12 is defined by a coaming 16. The hatch coaming 16 surrounds the opening 12. The top edge of the coaming has a turned-over flange 18, though not all hatch coamings include such a flange. A description of the structure and operation of a hopper car is set forth in the aforementioned U.S. Pat. No. 4,819,830.

The hatch cover 10 has a double vent structure. The cover 10 comprises a generally circular cover body 34 having a diametral base 31, visible on its under side in FIG. 3. The base has molded therein a pair of end portions 33 having arcuate outer surfaces 33A. The end portions 33 are joined by a pair of ribs 35 which are separated by a central depression 37. A pair of partitions 39 define channels 41 adjacent the end portions 33 and ribs 35.

The cover body also has a radial, disc-shaped seat 38 (FIG. 2). The seat 38 is connected to the base 31 and overlies the top of the turned-over flange 18 of coaming 16. The seat carries a pair of arcuate ledges 43 (FIGS. 2 and 3) which connect to the ends of the partitions 39. A circular, axial rim 36 adjoins the outer circumference of the seat 38. The inside diameter of the rim is slightly larger than the turned-over flange 18 of coaming 16. A disc-shaped seal 40 of suitable material is fitted within the space defined by the surfaces 33A, ledges 43, seat 38 and the inside edge of the rim 36. The seal 40 contacts coaming 16 to provide a weathertight engagement.

A pair of hoods 49 formed by walls 50 are disposed upon the outside surface of the cover body 34 and define air flow passages 52. Each wall 50 is integrally formed on the cover body 34 to afford a weathertight enclosure over the air passages. Air flow through the passages 52 is indicated by arrows 54. Air exits the hatch cover passages and flows into the hopper car through air outlet openings 48 defined by the ledges 43 and the partitions 39.

Posts 56 shown in FIGS. 2 and 3 connect the undersurface of wall 50 to seat 38 of the cover body. The posts 56 stiffen the structure and maintain integrity between walls 50 and the seat 38 while keeping to a minimum the obstruction of air flow through the air passages 52.

Walls 50 further define radial extension portions 58. The extensions can be considered as those portions of the walls 50 extending beyond the rim 36 of cover body 34. Extension portions 58 have end walls 60 and side walls 62 that project downwardly beneath seat 38. The side walls 62 merge with the outer surface of rim 36. A bottom wall 64 (FIG. 3) also adjoins the rim 36 and defines the underside of air passages 52.

The outer edge of bottom wall 64 extends and is connected to an air intake inner wall 66 which together with end wall 60 and side walls 62 define an air intake opening 68. Thus, each air passage 52 comprises an air intake opening 68, an air outlet opening 48 and a plenum section connecting the inlet and outlet.

It will be noted that the construction of the walls 60, 62 and 66 direct the air intake openings 68 in a downward direction. This construction provides efficient air exchange while presenting an air flow path that prevents entrance of contaminants from the exterior of the cover. That is, the air intake openings are radially outboard the coaming 16 and the air flow through each air passage 52 is sufficiently circuitous that droplets of water, snow or other contaminants are unlikely to be carried into and through the air passages 52.

Even with the described arrangement of the air intake opening, it is desirable to provide screens to positively prevent entry of contaminants. Thus, air intake openings 68 are shown covered by screen filters 70 in FIGS. 2 and 3. One of the filters 70 has been removed in the exploded view of FIG. 4. Filters 70 comprise a rectangular outer frame 80 and intermediate cross members 82. Guides 84 and tabs 86 are attached to the frame 80 and engage the inside surfaces of walls 60, 62 and 66. The filter material 75 may be any form of suitable filter media, such as reticulated polyurethane foam or nylon screen. It is removable, cleanable and replaceable.

Figure 5:
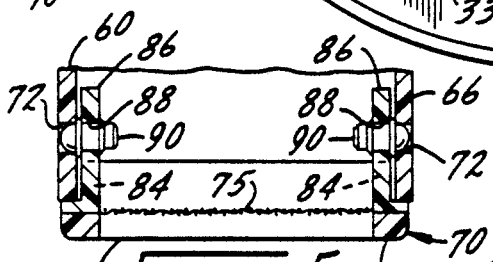
FIG. 5 is a partial section through an air intake, showing another embodiment of the attachment means for the air filter.
Figure 6:
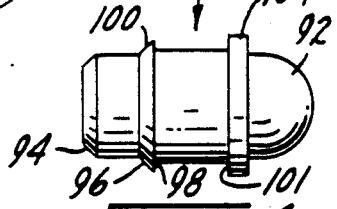
FIG. 6 is an enlarged view of the attachment rivet of FIG. 5.

A preferred embodiment of a filter retention means is illustrated in FIGS. 5 and 6. FIG. 5 is a partial sectional view of an extension portion 58, taken through the centerline of one of the tabs 86. Attachment rivets 90 are disposed within filter tab pinholes 88.

Referring now to FIG. 6, an enlarged view of rivet 90 shows details of the rivet which permit it to be easily inserted into pinhole 88. The rivet has a cylindrical body with annular retaining rings 100 and 104. The rings define vertical surfaces 98 and 101. Chamfered surfaces 94,96 permit the rivet 90 to be inserted into pinhole 88. Surface 98, together with surface 101 on retaining ring 104, retain rivet 90 in pinhole 88. Surfaces 98,101 are parallel to the surfaces of tab portion 86. The tab 86 is trapped between surfaces 98, 101 and the rivet is strongly held in place. Rivets 90 securely attach to filter tab members 86 and permit the filter to be popped into and out of the air intake opening 68 as often as is necessary.

The filter insertion process will now be described. The rounded, semi-spherical surface of rivet head 92 and flexure of tabs 86 permit the rivet 90 to slide against the inside surfaces of walls 60 and 66 when the filter 70 is being inserted over opening 68. As the filter 70 reaches its predimensioned insertion limit, rivet heads 92 pop into pinholes 72 in walls 60 and 66. This structure does not obstruct the air flow through the air passageways and eliminates loose parts which are liable to be misplaced when the filter is removed for cleaning or replacement.

Figure 4:
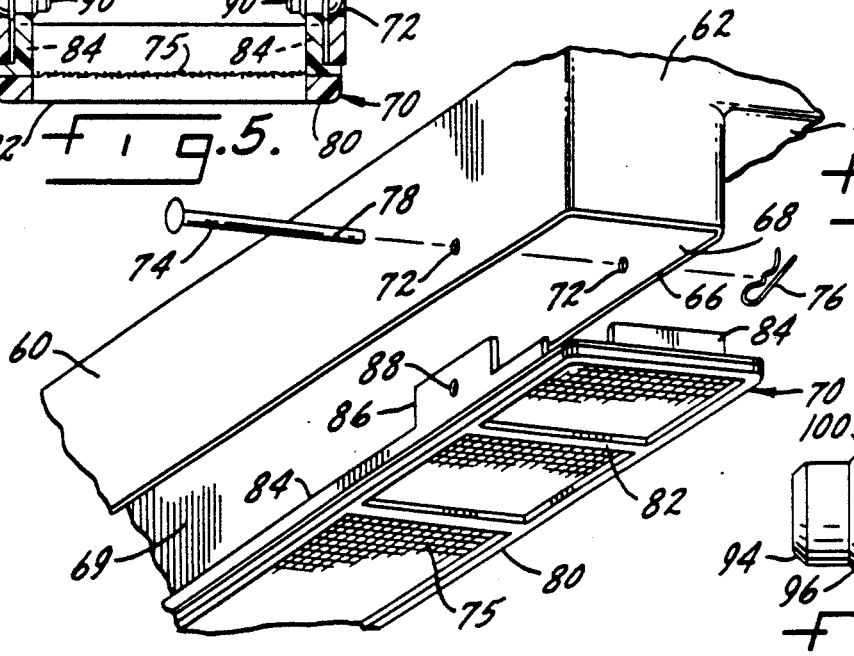
FIG. 4 is an exploded detail view of an air intake opening, air filter and air filter attachment means.

An alternative embodiment of a filter retention means is shown in FIG. 4. It is provided by tab members 86 extending from the longitudinal portions of guides 84. Tab members 86 include tab pinholes 88 which line up with pinholes 72 in walls 60 and 66 to permit passage of pins 74. Cotter pin 76 engages hole 78 to retain pin 74 within pinholes 72.

While screens 70 prevent entry of contaminants from the exterior of the hatch cover, it is equally important to prevent entry of particulates into the air passages from the interior of the car. A problem with prior hatch covers has been that material can be trapped in the cover's air passages during loading or unloading. This material may subsequently be dislodged and fall into the car compartment. For example, plastic pellets of one type or color may become lodged in the hatch cover during unloading. Then pellets of a different type or color are loaded and the hatch cover is closed. This may cause the trapped pellets to fall out of the cover and into the compartment, contaminating the new load.

The vented hatch cover of the present invention avoids this problem by protecting both the air intake and outlet openings of its air passages. An interior filter screen 45 (FIGS. 2, 9 and 10) is secured to the under side of the hatch cover to protect the interior portions of the air passages. The filter screen has a frame 47. Generally speaking, the frame is an annular, dish-shaped ring with a flange 59 and pair of diametral ribs 51. A filter material 53 is attached to the frame to complete the filter screen.

The screen 45 is removably secured to the cover body in the following manner. The outer half of the seal 40 is secured to the seat 38, preferably by adhesive as indicated at 55 in FIG. 10. The inner half of the seal has no adhesive applied thereto so it can be flexed away from the seat 38 to receive the flange 59 of the filter screen frame 47, as best seen in FIG. 10. The filter screen 45 prevents material from the interior of the car from becoming entrapped in the underside of the hatch cover, from whence subsequent dislodgement could contaminate lading of a different character. With the filter screen attached to the hatch cover in the illustrated manner, the screen will remain with the cover even when the cover is opened. Whenever necessary the filter screen 45 can be withdrawn from under the seal 40 for cleaning and/or replacement. It will be understood that while the use of the interior screen 45 is preferred, it is an option that could be left out in some aspects of the present invention.

Another aspect of the present invention is a latch mechanism for retaining the cover 10 on the coaming 16. A preferred embodiment of a latch is shown in FIGS. 7–9. The latch mechanism 110 comprises an arm 112 and two pressure plate crossbeams 114 fastened to the underside of the arm. Arm 112 is rotatably fixed at one end by a bolt 29 to a bracket 28. The bracket is fixedly attached to coaming 16. The bolt 29 allows the arm 112 to pivot between open and closed positions.

Cover retention hooks 116 and 118 are attached to the arm 112 and are sized to fit within notches 44 (FIGS. 2,3 and 9) in rim 36. The cover retention hooks may be connected to the arm body 112 by welding, as is shown with hook 116, or by a bracket 120 and nut-bolt connection 122, as is shown with hook 118. Although both retention hooks may have identical connections, preferably one of the retention hooks is welded onto the arm body and the other is a nut-bolt connection.

During installation of the hatch cover 10 in the latch 110, the cover is slipped into the jaw formed by retention hook 116 with the hook engaging a notch 44. The other retention hook 118 is then slid over the other of the notches 44 and hole 124 (shown in hidden lines) in bracket 120 is lined up with hole 126 in latching arm 112. Insertion and tightening of nut-bolt connection 122 fixes the hook 118. The position of hole 126 in the arm 112 is chosen such that the hooks 116 and 118 loosely retain the cover body 34 in the jaws formed by the hooks 116 and 118. This floating connection of the arm and cover allows adjustability of the hatch cover position on the coaming during closure while assuring the cover will be retained by the arm during opening. Accordingly, lifting the latch arm body 112 by pivoting about bolt 29 will also lift the hatch cover 10 from the coaming flange 18 and pivot it together with the latching arm 112.

Alternately, the hole 126 could be replaced by a slot which would permit the bracket 120 to fit snugly or loosely against the cover. A snug fit would only be desired if the hook were to be positioned while the cover was in the correct position on the coaming.

In the closed position the free end of arm 12 is engageable with a catch 21 (FIG. 9). The catch 21 is pivotally connected to a bracket 20 which is fixed to the coaming 16. The catch has an overcenter locking member 22 pivotally connected thereto on bolt 23. The locking member has open slots 25 along one edge. The free end of the arm 112 has a pair of spaced fingers each mounting a pin 30. To close and lock the arm 112, the catch 21 is first rotated clockwise (as seen in FIG. 9), out of the way of the arm 112. Then the arm is moved to a closed position. Next the catch 21 is rotated counterclockwise, bringing slots 25 into engagement with the pins 30. Then locking member 22 is rotated about bolt 23 to an overcenter position that holds pins 30 in the slots 25.

When the cover is closed, the crossbeams 114 engage the cover body 34 just beyond the ends of ridges 42 formed on the outside of the cover (FIG. 1). The ridge ends retain the crossbeams 114 in position on the cover body 34 and impede lateral shifting of the cover. The cover retention hooks 116 and 118 in notches 44 prevent rotational shifting. Crossbeams 114 maintain a downward pressure on the cover body when the cover is in the closed position, thus maintaining the seal between sealing member 40 and flange 18 of coaming 16.

An alternate form of arm is shown at 24 in FIG. 1. Arm 24 has a pressure plate 32 attached to it. The ridges 42 cooperate with pressure plate 32 to inhibit lateral movement of the cover body 34. Additional retention means (not shown) are possible and may be provided so as to engage optional retention notches 46 (FIG. 1) in cover body 34. A wire seal 26 which may be used to seal and prevent unauthorized opening of the locking member 22. Examples of the latching and holding mechanisms and of a latching arm for a hatch cover are disclosed in U.S. Pat. No. 4,690,070, which is herein incorporated by reference.

Alternative embodiments of the structure including the air intake can be utilized. These alternatives include walls which define an air passage having an even more circuitous route, and even having a filter or baffle system within the passage remote from the air intake opening. One example of such a vent is disclosed by aforementioned U.S. Pat. No. 4,819,830 (FIG. 3 thereof) and that portion of the disclosure of U.S. Pat. No. 4,819,830 is incorporated by reference herein. The exact shape of the walls defining the passages 52 is unimportant as long as sufficient air capacity is provided to vent the car compartment when it is being unloaded.

A major consideration in the wall structure is to define a plenum large enough to permit sufficient air flow for unloading purposes. It has been found that air flow required to compensate for volume change due to discharge of particulate matter is in the order of about twenty to twenty-five cubic feet of air per minute. Even faster unloading can be safely achieved with air flow of about thirty to sixty cubic feet per minute. Air passageways 52 have a cross-sectional area sufficient to accommodate such flow requirements.

It is a well known physical phenomenon that the volume of air which flows through the air passages 52 is constrained by the minimum cross section encountered by the air flow. In order to achieve the required volume of air flow into the compartment, it has been determined that the minimum cross-sectional area in any part of the air passageway cannot be less than about 30 square inches. Preferably, the minimum cross section for each of the two air passages 52 shown in FIGS. 1–3 is 22.5 square inches and the total minimum cross-sectional area for both hoods is 45 square inches. Thus, the chance of reducing efficiency of the unloading process or damaging the compartment body due to negative pressure is minimized.

The cover 10, filter frame 80, pins 74 and rivets 90 are preferably made from a polymeric material such as any high impact, weatherable, ultraviolet resistant thermoplastic, including polypropylene, A.B.S., polycarbonate, rigid P.V.C., nylon, and polyester. Of course, aluminum or stainless steel or fiberglass could be used. The seal 40 may comprise any soft pliable material but is preferably made of a one-piece vinyl gasket material to provide uniform sealing around the cover body.

While a preferred form of the invention has been shown and described, it will be understood that alterations to the illustrated embodiments could be made without departing from the scope of the following claims. In this regard it should be noted that the wall 60 need not extend upwardly. For example, it is contemplated, perhaps, that the cover body 34 could be continuous and the top walls 50 form a plenum on the interior surface of the cover body. An air passage would then be formed in walls 50 rather than in the cover body 34.

Another alternative is to have more than the preferred two hoods and air passageways, and to provide a plurality of hoods having a total minimum cross section area not less than 30 square inches.

I claim:

1. A vented hatch cover engageable with the coaming of a hatch opening of a compartment to removably cover said opening, comprising:

a) a cover body having a sealing ring and being sized to fit over the compartment hatch opening, said sealing ring being adapted to engage the coaming of the hatch opening;

b) at least two air outlet openings defined by said cover body, the minimum cross-sectional area defined by the total of all said air outlet openings being not less than 30 square inches; and c) at least two hood members connected to said cover body, each defining an air passage having an air intake opening and a plenum extending from said air intake opening to one of said air outlet passages, and wherein each air passage defines a point of minimum cross-sectional area and the aggregate cross-sectional area of all said minimum areas is not less than 30 square inches.

2. The hatch cover according to claim 1 wherein said hood member further comprises an extension portion which extends beyond the periphery of said cover body.

3. The hatch cover according to claim 2 wherein said cover body comprises an inner surface facing toward the compartment and an outer surface facing away from the compartment, and said hood comprises an extension portion which extends closer to the interior of the compartment than said cover body inner surface.

4. The hatch cover according to claim 3 wherein said air intake opening further comprises an outer edge which is substantially equidistant from the outside surface of the compartment along its periphery.

5. The hatch cover according to claim 1 wherein the cross-sectional area of the air intake opening exceeds the minimum cross-sectional area of the plenum.

6. The hatch cover according to claim 1 wherein said air intake opening is radially spaced from the hatch opening and coaming, and the axis of the air intake opening is parallel to that of the hatch opening.

7. The hatch cover according to claim 1 wherein said hoods include filter means disposed in said air intake openings for preventing contaminants from flowing into said air intake opening.

8. The hatch cover according to claim 7 wherein said filter means comprises a woven nylon screen.

9. The hatch cover according to claim 7 wherein said filter means is replaceably removable.

10. The hatch cover according to claim 1 wherein the cover body includes notches therein for receiving means for retaining the cover on the coaming.

11. The hatch cover according to claim 1 wherein each hood member further comprises at least one discrete post extending through said plenum for connecting said hood member to said cover body.

12. The hatch cover according to claim 1 wherein said cover body sealing ring includes an inside surface defining a seat about the periphery thereof, a seal for sealing against the coaming of a hatch disposed upon said seat and wherein said air intake opening is disposed outboard of said seat surface.

13. The hatch cover according to claim 12 wherein each said hood member air intake opening is located axially below the sealing ring when said hatch cover is attached to a hatch opening.

14. The hatch cover according to claim 13 wherein said hood member extension portion extends axially below said cover body.

15. The hatch cover according to claim 1 wherein the aggregate cross-sectional area of all said minimum areas is about 45 square inches.

16. The hatch cover according to claim 15 further wherein each hood member plenum has a minimum cross-sectional area of approximately 22.5 square inches.

17. The hatch cover according to claim 1 wherein each said hood member air intake opening has a cross-sectional area greater than the minimum cross-sectional area of said air passage.

18. The hatch cover according to claim 7 further comprising a filter screen disposed over said air outlet openings for preventing contaminants from flowing into said air outlet openings.

19. The vented hatch cover according to claim 1 further comprising a latching arm for releasably retaining said hatch cover on the coaming of a hatch opening.

20. The vented hatch cover according to claim 19 wherein said latching arm comprises an elongate arm including a pivotable first end and a latchable second end having latch means, two crossbeams attached to said arm substantially perpendicular to said arm at points spaced from a transverse centerline, and a plurality of cover retention hooks for engaging notches in the cover and thereby loosely securing said latching arm to said cover body.

21. In a vented hatch cover of the type for removably covering the opening to a compartment, the hatch cover having walls defining an air inlet opening, the improvement comprising a filter element for the air inlet opening, the filter element including:

a) a peripheral outer frame defining an opening;

b) a plurality of tab members connected to said outer frame and extending generally perpendicularly from the plane of said frame, each said tab member including at least one hole;

c) retention means disposed in said tab member holes and engageable with the walls of the air inlet opening in the hatch cover to detachably secure said outer frame within the air inlet opening; and d) a mesh filter member attached to the outer frame and completely overlaying the opening defined by said outer frame.

22. The filter apparatus according to claim 21 further comprising aligned first and second attachment holes in said walls and wherein said retention means comprises a pin disposed through the first attachment hole and a first tab member hole on a first tab member and through a second attachment hole and a second tab member hole on a second tab member, where said first and second tab members are disposed on said outer frame in opposing relation.

23. The filter apparatus according to claim 21 wherein said retention means comprises a plurality of rivets, said rivets being attached to said tab members and extending through said tab member holes, each said rivet including a body, a rounded head disposed at a proximate end of said body, a first annular flange extending about said body adjacent said rounded head, and a second annular flange disposed about said body between said first annular flange and a distal end of said body, wherein said first annular flange extends farther from the surface of said body than said second annular flange to provide for easier insertion of said distal end into said tab member holes.

24. The filter apparatus according to claim 23 wherein each tab member has a predetermined thickness and each said rivet further comprises first and second flanges having facing side walls separated by a distance approximately equal to the thickness of said tab member, whereby said side walls contact said tab member and retain said rivet in said tab member hole.

25. The filter apparatus according to claim 21 further comprising guide members extending from said outer frame and sized to engage the inner surfaces of the walls of the air inlet passage.

26. The filter apparatus according to claim 21 wherein said mesh filter member is a woven nylon mesh screen.

27. In a vented hatch cover assembly including a cover body, a latching arm comprising:

a) an elongate arm having a pivotable first end and a latchable second end;

b) first and second crossbeams connected to said arm spaced from each other and from the center of the arm;

c) first and second cover retention hooks attached to the arm for engagement with the cover body, whereby said cover body is secured together with the latching arm and is moved in conjunction therewith, and said first and second crossbeams provide downward pressure on portions of the cover body spaced from and on opposite sides of a central portion of the cover body when the second end of the arm is latched.

28. The latching arm according to claim 27 wherein one of said hooks is fixedly attached to the arm and the other hook is adjustably attached to the arm.

29. The latching arm according to claim 27 wherein the arm has spaced fingers at its second end for receiving a latch means therebetween.

30. The latching arm according to claim 27 wherein the cover body has a pair of notches formed therein and wherein the cover retention hooks are sized to engage the notches.

31. A vented hatch cover for securing to the coaming of a hatch opening of a compartment, comprising:

a) a cover body having a seal and being sized to fit over the compartment hatch opening, said seal being adapted to engage the coaming of the hatch opening;

b) at least one air outlet passage defined by said cover body;

c) at least one hood member connected to said cover body for providing a weathertight enclosure over said air outlet passage, the hood member defining an air passage having an air intake opening and a plenum extending from said air intake opening to said air outlet opening;

d) a first filter element attached to the hood member for preventing entry of contaminants into the air inlet opening; and e) a second air filter element attached to the cover body for preventing entry of contaminants into the air outlet opening.

32. The hatch cover of claim 31 wherein both the first and second air filter elements are replaceably removable from the hood and cover body respectively.

33. The hatch cover of claim 31 wherein the second air filter element comprises a semi-rigid, annular ring defining a central aperture, at least one cross rib connected to the ring and extending across the central aperture and filter media attached to the ring and overlying the entire central aperture such that any air passing through said aperture must flow through the filter media.

34. The hatch cover of claim 31 wherein the hatch cover includes a radial, disc-shaped seat and an outer portion of the seal is adhesively secured to the seat, and the second air filter element has a flange disposed between an inner portion of the seal and the seat to removably retain the second filter element.

* * * * *